United States Patent [19]

Shobert, II

[11] 3,949,711

[45] Apr. 13, 1976

[54] ROTARY ENGINE WITH GRAPHITE HOUSING

[75] Inventor: Erle I. Shobert, II, St. Marys, Pa.

[73] Assignee: Stackpole Carbon Company, St. Marys, Pa.

[22] Filed: Feb. 8, 1974

[21] Appl. No.: 440,842

[52] U.S. Cl. ..... 123/8.01; 418/152

[51] Int. Cl.[2] ..... F02B 53/00

[58] Field of Search ..... 418/152, 178, 179; 417/DIG. 1; 415/214; 123/8.01, 8.45; 220/3, 71; 60/200 A

[56] References Cited

UNITED STATES PATENTS

| | | | |
|---|---|---|---|
| 2,611,323 | 9/1952 | Digney | 418/152 |
| 2,662,483 | 12/1953 | Smith et al. | 418/152 |
| 2,925,786 | 2/1960 | Hill | 418/152 |
| 3,191,852 | 6/1965 | Kratz et al. | 418/152 |
| 3,196,848 | 7/1965 | Bensinger | 123/8.45 |
| 3,466,219 | 9/1969 | Schwartz | 60/200 A X |
| 3,602,602 | 8/1971 | Motta | 415/214 |
| 3,602,608 | 8/1971 | Morley | 415/214 |
| 3,765,557 | 10/1973 | Giver | 220/71 X |

*Primary Examiner*—William L. Freeh
*Assistant Examiner*—Michael Koczo, Jr.
*Attorney, Agent, or Firm*—Brown, Murray, Flick & Peckham

[57] ABSTRACT

A rotary engine has a housing in which a rotor is driven by the combustion of fuel. The side wall of the housing extending around the rotor is composed of graphite throughout its thickness and preferably reinforced by a wrapping of graphite fiber tape.

4 Claims, 2 Drawing Figures

ROTARY ENGINE WITH GRAPHITE HOUSING

There are various types of internal combustion rotary engines, in which the rotors are provided with sealing means that slide along the inner surfaces of the combustion chamber walls as fuel and air are drawn into the chambers and then compressed and ignited to drive the rotors. Some rotary engines have noncircular combustion chambers that house circular rotors provided with radial vanes that slide in and out as they slide along the inner surfaces of the chamber side walls. Others are of the Wankel type as shown in U.S. Pat. No. 2,988,065. In either case, the seals between the rotors and the surrounding walls of the housings are a serious problem because of wear and occasional scoring of the chamber walls. In rotary pumps this problem has been solved by inserting a graphite liner in the pump chamber so that the seals can be made of metal. The graphite liner will wear much more slowly than graphite seals engaging a metal wall, because all of the wear on a seal is concentrated along a narrow line while wear of a liner is spread over a large area. However, the same approach cannot be made to solve the seal wear problem in a rotary engine, because a graphite liner for a rotary engine combustion chamber is not satisfactory and cannot be used. Due to the burning fuel in an engine, the metal housing around a graphite liner becomes quite hot and would expand considerably more than the liner, thereby separating from the liner and leaving it unsupported. Without the benefit of its metal backing the liner would not be strong enough to resist the internal forces produced by the explosions and expanding gases in an internal combustion engine. The internal pressure in such an engine may go as high as 1000 psi.

It is among the objects of this invention to provide a rotary engine which has the necessary strength, which is cheaper to build than conventional rotary engines, which has a much longer life than conventional rotary engines and in which the seals carried by the rotor have a long life.

Figure 1:
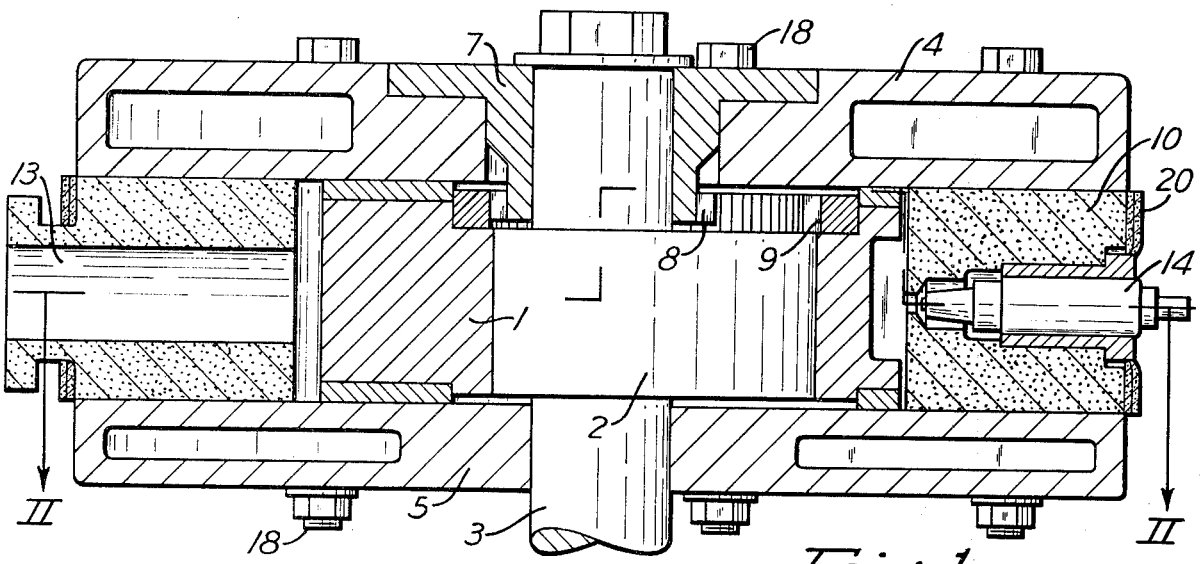
Figure 2:
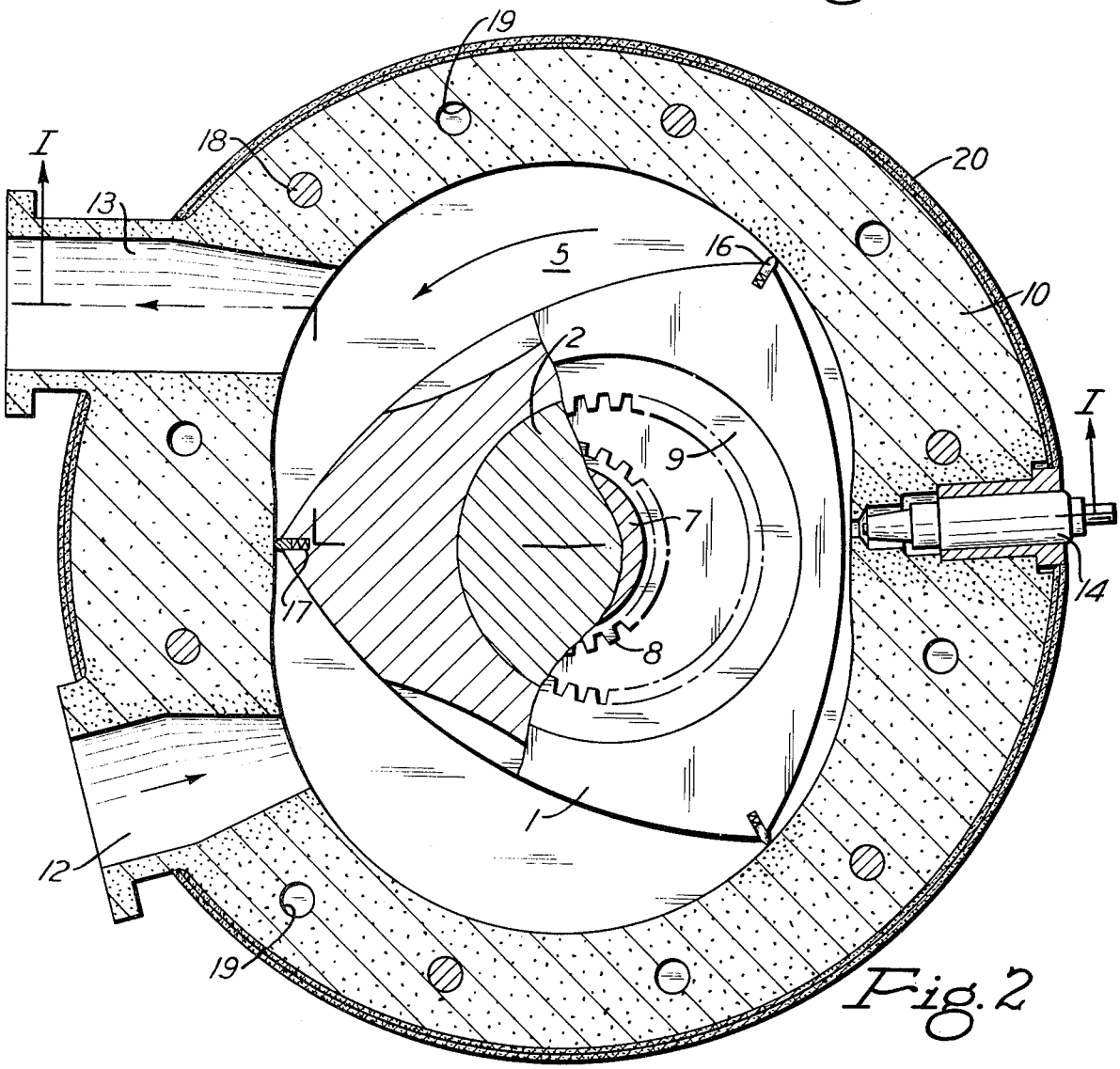

The invention is illustrated in the accompanying drawings as applied to a Wankel type engine, although it is equally applicable to other types of rotary engines:

FIG. 1 being a cross section taken on the line I—I of FIG. 2; and

FIG. 2 being a section perpendicular to the axis of the engine and taken on the line II—II of FIG. 1.

Referring to the drawings, a generally triangular rotor 1 is rotatably mounted on an eccentric 2 secured to a shaft 3 extending through the opposite end walls 4 and 5 of an internal combustion engine housing. One end of the shaft is journaled in a stationary bearing 7 provided at its inner end with external gear teeth 8. These teeth mesh with some of the internal teeth of a ring gear 9 secured to one end of the rotor. As the rotor rotates, it drives the shaft in a well-known manner. The rotor operates in a housing chamber defined by the end walls and a side wall 10 surrounding the rotor between them. The chamber is in the form of a two-lobed epitrochoid.

The side wall of the housing is provided in one side with a fuel mixture inlet passage 12 for the chamber and with an outlet passage 13 for exhaust gases. At the opposite side of the housing it is provided with a small a in which aa spark plug 14 is mounted. As the rotor rotates in the housing, it draws in fuel that it then compresses between itself and the housing side wall in the vicinity of the spark plug, by which the fuel mixture is ignited. The explosion and resulting expansion of gases rotate the rotor, and the exhaust gases escape through the chamber outlet 13.

In accordance with this invention the straight seals 16, which are mounted in radial slots 17 in the apices of the rotor and project radially from them a short distance, are made of metal or a combination of metal and graphite that is long wearing. The side wall 10 of the housing, on the other hand, is not made of metal as in the past, but from a solid block of high strength impervious graphite that has been machined out to produce the specially shaped combustion chamber. Therefore, the housing side wall is graphite throughout its thickness. One of the end walls of the housing may be integral with the side wall if desired, in which case it, too, would be graphite. However, metal end walls are illustrated, as wear on the end seals of the rotor is not as great a problem as on its peripheral or apex seals 16, which are parallel to its axis. The peripheral seals slide along the inner surface of the surrounding graphite wall of the chamber. This wall can vary in thickness, being thicker where it is subjected to the most stress in use. Also, the side wall may be provided with openings parallel to shaft 3 for bolts 18 that clamp the end walls of the housing in place, and with other openings 19 for the circulation of cooling water.

Another feature of this invention is that the housing side wall 10 is reinforced and strengthened by wrapping it tightly in a high modulus graphite fiber tape 20 that has great tensile strength. Since the tape is made of graphite, it will have the same coefficient of thermal expansion as the graphite housing. The housing will withstand the high pressure involved in internal combustion engines.

The life of the rotor apex seals in the Wankel engine, for example, has been one of the major limiting factors in achieving a reasonable life without maintenance. That problem now becomes minor in view of this invention. Also, it is much simpler and cheaper to machine a graphite rotor chamber than a metal one. In fact, wood working tools can be used for that purpose. A fine, accurate internal finish is not required initially because the rotor seals will seat-in the graphite surface. Wear of the graphite chamber wall will be uniform and there will not be the catastrophic scuffing or seizure that causes drastic failure and leakage in the case of metal housings.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. In a rotary engine comprising a housing having a side wall and parallel end walls defining a chamber, a shaft rotatably mounted in an end wall and extending into said chamber, a rotor in the chamber mounted on the shaft, metallic sealing means projecting from the rotor into sliding engagement with said side wall, said housing being provided with fuel intake and exhaust openings for said chamber, means carried by the housing for periodically igniting fuel in the chamber to drive the rotor, and means operatively connecting the rotor with said shaft to rotate the shaft; the improvement characterized by the side wall of the housing being composed of graphite throughout its thickness.

2. In a rotary engine according to claim 1, graphite fiber tape wrapped tightly around said housing side wall to strengthen it.

3. In a rotary engine according to claim 1, said chamber being in the form of a two-lobed epitrochoid, said rotor being triangular with said sealing means projecting from its apices and having an axial passage for said shaft, and an eccentric rigidly mounted on the shaft in said passage.

4. In a rotary engine according to claim 2, said chamber being in the form of a two-lobed epitrochoid, said rotor being triangular with said sealing means projecting from its apices and having an axial passage for said shaft, and an eccentric rigidly mounted on the shaft in said passage.

* * * * *